US011172803B2

(12) United States Patent
Policicchio et al.

(10) Patent No.: US 11,172,803 B2
(45) Date of Patent: Nov. 16, 2021

(54) CLEANING SHEETS HAVING COATING THEREON

(71) Applicant: The Procter & Gamble Company, Cincinnati, OH (US)

(72) Inventors: Nicola John Policicchio, Mason, OH (US); Brian Lee Keith, Hamersville, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 258 days.

(21) Appl. No.: 15/235,288

(22) Filed: Aug. 12, 2016

(65) Prior Publication Data

US 2018/0042439 A1 Feb. 15, 2018

(51) Int. Cl.

| | |
|---|---|
| ***A47L 13/16*** | (2006.01) |
| ***A47L 13/17*** | (2006.01) |
| ***A47L 13/38*** | (2006.01) |
| *A47L 13/44* | (2006.01) |
| *A47L 13/10* | (2006.01) |
| *A47L 13/20* | (2006.01) |
| *A47L 13/24* | (2006.01) |

(Continued)

(52) U.S. Cl.

CPC ..... *A47L 13/16* (2013.01); *A47L 13/17* (2013.01); *A47L 13/38* (2013.01); *A47L 13/10* (2013.01); *A47L 13/12* (2013.01); *A47L 13/20* (2013.01); *A47L 13/24* (2013.01); *A47L 13/44* (2013.01); *A47L 13/46* (2013.01)

(58) Field of Classification Search

CPC ..... A47L 13/17; A47L 13/38; A47L 13/12; A47L 13/44; A47L 13/16; A47L 13/20; A47L 13/10; A47L 13/24; D04H 1/495; B65H 35/04; B25G 3/24; B32B 2432/00; B32B 5/022; B32B 5/12; B32B 5/26

USPC ..... 15/229.4, 114, 104.9

See application file for complete search history.

(56) References Cited

U.S. PATENT DOCUMENTS 2,849,324 A * 8/1958 Cox ..... C09G 1/08 106/10

3,494,821 A 2/1970 Evans (Continued)

FOREIGN PATENT DOCUMENTS

CA 2397426 C * 7/2007 ..... A47L 13/16

EP 1482828 B1 9/2009

(Continued)

OTHER PUBLICATIONS

PCT Search Report PCT/US2017/046396; dated Nov. 9, 2017; 17 Pages.

*Primary Examiner* — Katina N. Henson

(74) *Attorney, Agent, or Firm* — Gary J. Foose

(57) ABSTRACT

A nonwoven sheet, having a first outwardly facing surface and a second outwardly facing surface. Wax is disposed in a wax pattern on the first surface; and oil is disposed in an oil pattern on the second surface. The oil pattern is not coincident the wax pattern so that wax blocks the oil from permeating through to the first surface. The first surface may be textured with peaks and valleys, having wax disposed on the peaks. This arrangement keeps the oil from contacting the target surface and leaving residue, while allowing the oil to collect and retain debris. The sheet may be executed as a dry sheet for cleaning surfaces such as floors or as a duster.

10 Claims, 8 Drawing Sheets

(51) Int. Cl.
*A47L 13/12* (2006.01)
*A47L 13/46* (2006.01)

(56) References Cited

U.S. PATENT DOCUMENTS

| | | | | |
|---|---|---|---|---|
| 3,629,047 | A | 12/1971 | Davison | |
| 4,144,370 | A | 3/1979 | Boulton | |
| 4,683,001 | A | 7/1987 | Floyd et al. | |
| 4,808,467 | A | 2/1989 | Suskind et al. | |
| 5,144,729 | A | 9/1992 | Austin et al. | |
| 5,525,397 | A | 6/1996 | Shizuno et al. | |
| 6,726,386 | B1 | 4/2004 | Gruenbacher et al. | |
| 6,777,064 | B1 | 8/2004 | Brown et al. | |
| 6,790,794 | B2 * | 9/2004 | Fereshtehkhou | A47L 13/16 442/35 |
| 6,797,357 | B2 | 9/2004 | Fereshtehkhou et al. | |
| 6,813,801 | B2 | 11/2004 | Tanaka et al. | |
| 6,936,330 | B2 | 8/2005 | Fereshtehkhou et al. | |
| 7,560,398 | B2 | 7/2009 | Zillig et al. | |
| 8,763,197 | B2 | 7/2014 | Policicchio et al. | |
| 8,851,776 | B2 | 10/2014 | Schwarz et al. | |
| 9,198,553 | B2 | 12/2015 | Policicchio | |
| 9,204,775 | B2 | 12/2015 | Pung et al. | |
| 9,339,165 | B2 | 5/2016 | Vetter et al. | |
| 2002/0148061 | A1 | 10/2002 | Tanaka et al. | |
| 2004/0163674 | A1 | 8/2004 | Policicchio et al. | |
| 2006/0128240 | A1 | 6/2006 | Policicchio et al. | |
| 2013/0111682 | A1 | 5/2013 | Pung et al. | |
| 2013/0232714 | A1 | 9/2013 | Policicchio | |

FOREIGN PATENT DOCUMENTS

| | | | | |
|---|---|---|---|---|
| JP | 1967120 | A2 * | 9/2008 | A47L 13/38 |
| JP | WO 2014087796 | A1 * | 6/2014 | A47L 13/16 |

* cited by examiner

CLEANING SHEETS HAVING COATING THEREON

FIELD OF THE INVENTION

This invention relates to cleaning sheets for removal and entrapment of debris from a target surface without leaving residue.

BACKGROUND OF THE INVENTION

Nonwoven sheets for cleaning hard surfaces, such as floors, countertops, etc., are known in the art as shown in U.S. Pat. Nos. 3,629,047 and 5144729. To provide durability, a continuous filament or network structure has been proposed, as disclosed in U.S. Pat. Nos. 3,494,821; 4,144,370 and 4,808,467 and polymers as described in U.S. Pat. No. 5,525,397. Other attempts include providing a first surface which is textured with peaks and valleys, so that debris can be entrapped within the valleys.

Further attempts to improve such cleaning sheets include disposing additives such as wax or oil on the sheets to capture debris, as disclosed in 2004/0163674, U.S. Pat. Nos. 6,777,064; 6,797,357; 6,936,330; 7,560,398; 9,204,775, 9,339,165 and EP 1482828.

Likewise, nonwoven sheets are used in combination with tow fibers to make disposable dusters, as disclosed in U.S. Pat. Nos. 6,813,801; 8,763,197; 8,851,776 and 9,198,553. Such nonwoven sheets may also include additives such as wax or oil to capture debris. Yet another format is a mitt with a rupturable reservoir, as found in U.S. Pat. No. 6,726,386.

But the common wax and/or oil additives are not fully sufficient. An oil coating can cause residue on the target surface. Oil may be transferred from the surface of the sheet in contact with the target surface directly to that surface. If oil is disposed on the second surface, also known as the backside of the sheet, the oil may migrate through to the front side of the sheet and still cause residue.

Likewise, wax alone may be insufficient to capture debris, as wax can be subject to cohesive failure, and likewise deposit residue on the target surface. Wax and oil residue is undesirable, as the residue can attract more debris and cause a sticky tactile sensation.

Accordingly, it is an object of the invention to provide a sheet for cleaning hard surfaces which can efficaciously capture debris without leaving residue.

SUMMARY OF THE INVENTION

The invention comprises a sheet having a first outwardly facing surface and a second outwardly facing surface opposed thereto. Wax is disposed on the first surface; and oil is disposed on the second surface of the sheet. The first surface may have peaks and valleys with the wax disposed on the peaks. The sheet may be executed with a cleaning implement for floor cleaning, as a duster, etc.

BRIEF DESCRIPTION OF THE DRAWINGS

FIGS. 3-9B are to scale.

FIG. 3 is a graphical representation of the effect of surface coating on a flat sheet.

FIG. 4 is a graphical representation of the effect of surface coating on a textured sheet.

FIG. 5 is a graphical representation of the effect of surface coating the gather strips on a duster having gather strips on the bottom thereof.

FIG. 6 is a graphical representation of the effect of surface coating the top gather strips and bottom gather strips on a duster having gather strips on the top and bottom thereof.

FIGS. 9A and 9B are frontal photographs of the first surfaces of a textured sheet and flat sheet, respectively, having microcrystalline wax applied to the first surfaces thereof and mineral oil applied to the second surfaces thereof.

DETAILED DESCRIPTION OF THE INVENTION

Figure 1A:
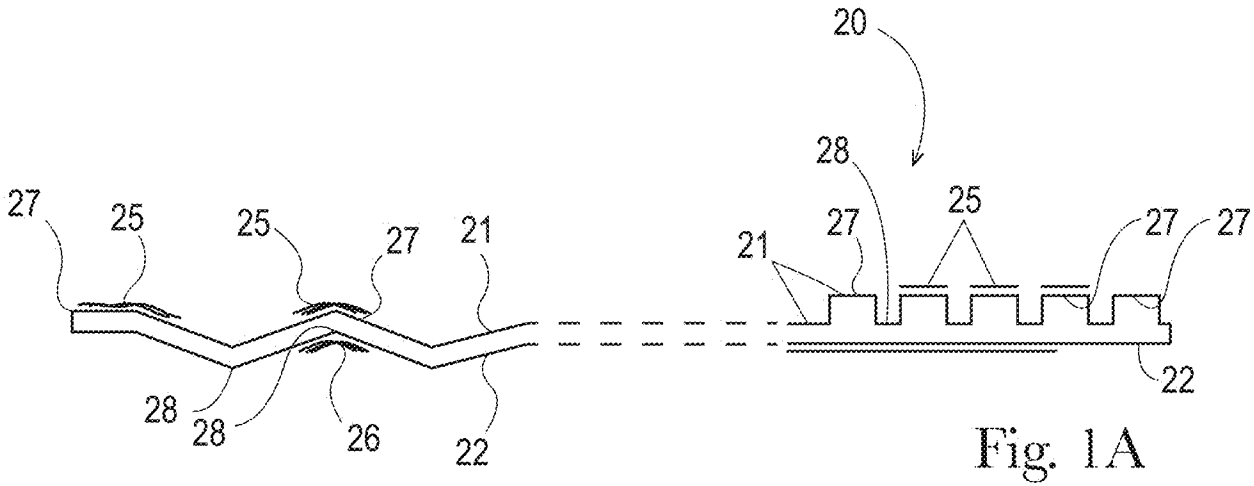
FIG. 1A is a schematic side elevational view of a textured sheet according to the present invention.
Figure 1B:
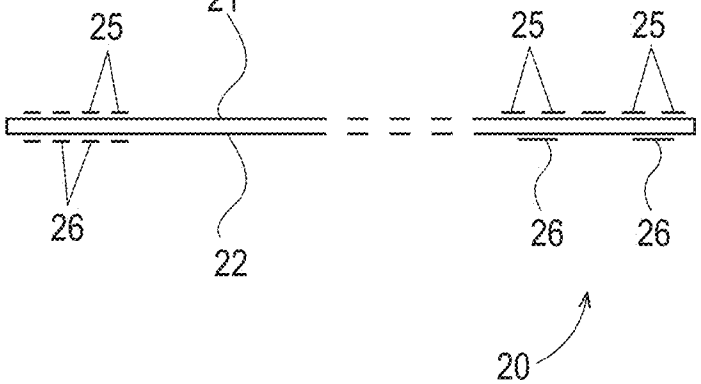
FIG. 1B is a schematic side elevational view of a flat sheet according to the present invention

Referring to FIGS. 1A-1B, in one embodiment the invention comprises a sheet (20). The sheet (20) may be used for cleaning debris such as dust, lint, hair, grass, sand, food crumbs from a target surface. The target surface may be a hard surface, such as a floor, table or countertop, or may be a soft surface such as cloth or fabric.

The term "hydroentanglement" is a process for making a sheet (20) wherein a layer of loose fibrous material (e.g., polyester) is supported on an apertured patterning member and subjected to water pressure differentials sufficiently great to cause the individual fibers to entangle mechanically to provide a sheet (20). The apertured patterning member can be formed, e.g., from a woven screen, a perforated metal plate, etc.

The term "Z-dimension" refers to the dimension orthogonal to the length and width of the cleaning sheet (20) of the present invention, or a component thereof. The Z-dimension usually corresponds to the thickness of the sheet (20). The term "X-Y dimensions" refers to the plane orthogonal to the thickness of the cleaning sheet (20). The X and Y dimensions usually correspond to the length and width, respectively, of the sheet (20). All percentages, ratios and proportions used herein are by weight unless otherwise specified.

The sheet (20) extends in the X-Y dimensions and has a first surface (21) and a second surface (22) opposed thereto. The sheet (20) may be macroscopically flat, or, preferably, is macroscopically three dimensional. Both the first surface (21) and second surface (22) may be textured in the Z direction. Or preferably, the first surface (21) is textured in the Z direction and the second surface (22) is macroscopically flat.

An essentially flat sheet (20) is defined as a sheet (20) that visually appears to be uniform on a macro scale. While visually flat on a macro scale, on a micro scale these sheets still comprise of high spots (peaks) and low spots (valleys). For these types of flat sheets (20) the peaks (27) and valleys (28) have an average height differential less than about 0.5 mm.

Flat sheets (20) can further be described by the caliper and basis weight. In a preferred embodiment for a flat sheet (20)

the caliper is less than 1 mm and the basis weight is less than 200 grams per square meter. Even a more preferred embodiment the caliper is less than 0.75 mm and basis weight is less than 150 grams per square meter. Texture sheets (20) on the other hand are generally understood to have higher calipers at lower basis weights.

By textured it is meant that the surface comprises peaks (27) and valleys (28) in any shape or pattern. The peaks (27) and valleys (28) may be visually determined as peaks (27) visually extending outward from the plane of the first surface, while valleys (28) are recessed below the peaks (27). In a preferred embodiment for a textures sheet (20) the caliper is greater than 1 mm and the basis weight less than 120, and preferably less than 90, grams per square meter.

As used herein, the term "texture" is used to describe the individual's perception of the spatial variation of visible light due to surface structure of a portion of an object in two dimensions and occurs in the Z dimension. Textures can be visual effects generated by surface roughness and visual illusion created by mere color or pattern. Texture may be the result of the natural characteristics of a given material as a result of the material formation process. Textures may also be imparted to a material using techniques known to those skilled in the art including, for example, hydroentangling, printing, embossing, bonding, aperturing and the like.

As used herein, the term "pattern" is used to describe the individual's perception of spatial variation of visible light due to contrasts in spatial variation of light due to the color, form, andtexture of a portion of an object incorporated into the object by the manufactory of the elements. This contrast creates various visual distinct regions or lines sometimes referred to as "figures" within its surrounding sometimes referred to as "ground." Patterns can be formed by combinations of contrasting color, form, and texture relative to its surroundings. An element can have more than one pattern, but each pattern would be distinguishable, recognizable, and separate from the other patterns on the element. Pattern is also a term used to describe the observer's perception of combined effect of more than one color, form, or texture within a portion of an observer's field of view. Patterns may have a "length", "extent", "shape", "position" and "orientation".

The sheet (20) can be a woven or nonwoven sheet (20). A textured sheet (20) is preferred, as may be made by a known hydroentangling process using a three-dimensional screen having variation in the Z dimension. The sheet (20) may be a textured formed film, typically polyolefinic, such as LDPE. The sheet (20) may be a laminate of the foregoing.

As described in further detail below, the sheet (20) is pervious to permeation of oil (26) therethrough in the Z dimension. The oil (26) may particularly permeate from the second surface (22) to or towards the first surface (21).

Suitable materials for the sheet (20) include, for example, natural cellulose fibers, such as softwoods, hardwoods and blends thereof. Suitable materials also include synthetic fibers such as polyolefins (e.g., polyethylene and polypropylene), polyesters, polyamides, synthetic cellulosics (e.g., RAYON®), and blends thereof. The sheet (20) can be biodegradable and comprise virgin and/or recycled fibers. The nonwoven cleaning sheet (20) may be made according to a hydro-entangling process to provide a texture and a basis weight of about 20 to about 120 gsm. The cleaning sheet (20) according to the present invention may be made according to commonly assigned U.S. Pat. Nos. 6,305,046; 6,484,346; 6,561,354; 6,645,604; 6,651,290; 6,777,064; 6,790,794; 6,797,357; 6,936,330; D409,343; D423,742; D489,537; D498,930; D499,887; D501,609; D511,251 and/or D615,378.

The sheet (20) can comprise a single layer or two or more layers joined together. Preferably, the sheets (20) are nonwovens made by hydroentangling. If plural layers are used, it may be desired to slightly entangle plural layers prior to joining by entanglement.

A polymeric net, known as a scrim material, may be incorporated into the sheet (20) though lamination via heat, chemical means such as adhesives and/or hydroentanglement, as described in U.S. Pat. No. 4,636,419. The scrim can be polyethylene, polypropylene, copolymers thereof, poly (butylene terephthalate), polyethylene terephthalate, Nylon 6, Nylon 66, and the like. Incorporation of the scrim material into a cleaning sheet (20), followed by heating, may be used to provide macroscopic three-dimensional character to the sheet (20). This macroscopic three-dimensionality has been found to greatly enhance cleaning performance of the cleaning sheet (20), even where the basis weight of the sheet (20) is essentially uniform. In particular, macroscopic three-dimensionality is achieved when the scrim/fiber composite is subjected to heating, then cooling. This process results in shrinkage (in the X-Y dimension) of the scrim and, as a result of its being attached with the fibers, provides a sheet (20) with greater three-dimensionality.

The sheet (20) may have an Average Height Differential of at least about 0.5 mm, more preferably at least about 1 mm, and still more preferably at least about 1.5 mm. The Average Height Differential of at least one outward surface will typically be from about 0.5 to about 6 mm, more typically from about 1 to about 3 mm, although an Average Height Differential of 10 to 15 mm may be suitable.

The cleaning performance of the sheet (20) may be enhanced by treating the sheet (20), a variety of additives, including surfactants or lubricants, which enhance adherence of soils (26) to the sheet (20). Such additives may be added to the cleaning sheet (20) at a level sufficient to enhance the ability of the sheet (20) to adhere soils (26), particularly at an add-on level of at least about 0.01%, more preferably at least about 0.1%, more preferably at least about 0.5%, more preferably at least about 1%, still more preferably at least about 3%, still more preferably at least about 4%, by weight. Typically, the add-on level is from about 0.1 to about 25%, more preferably from about 0.5 to about 20%, more preferably from about 1 to about 15%, still more preferably from about 19 to about 26% by weight. A preferred additive is a wax (25), oil (26) or prophetically a mixture thereof.

As used herein oil (26) includes various flowable coatings (26), and which preferably remain flowable at room temperature conditions (25 degrees C.) and is non VOC. The oil (26) is believed to promote desirable tactile feel, and produce a desirable and controlled coefficient of friction on the second surface (22) of the sheet (20). Suitable oils (26) include mineral oil (26), silicone oils (26), non-VOC solvents, petroleum jelly silicone and coatings which are free flowing at 20 degrees C. The oil (26) may not only comprise hydrocarbon products, but also comprise water based pressure sensitive adhesives, natural based oils such as coconut oil, vegetable oil, almond oil, essential oils, aroma therapy oils and the like. The oil (26) and/or other free flowing additive can further comprise of surfactant to aide in cleaning and spreading. Typically, the add-on level of the oil and/or other free flowing additive (26) is about 0.1 to about 25%, preferably about 5% to about 25% by weight.

The oil (26) may have a viscosity less than 1000, preferably less than 500 and more preferably less than 100 centipoise at 20 degrees C., but greater than 5 or 10 centipoise at 20 degrees C. This viscosity range is believed to be adequate to promote spreading of the oil (26), particularly on the second surface (22) of the sheet (20). If desired, surfactant may be added to the oil (26) to promote spreading of the oil (26) on the second surface (22) of the sheet (20). As the sheet (20) density increases, the viscosity may decrease, due to increased capillary action.

Energy from sources such as heat, ultrasonic vibration, UV and the like can optionally be used to enhance the penetration ability of oil and/or other free flowing coating (26) when applied to the second surface (22) of to enhance migration into valleys (28) of the sheet (20).

The oil (26) may be applied to the first surface (21) of the sheet (20), the second surface (22) of the sheet (20) or both surfaces of the sheet (20), using a sprayer, roll coater or slot extruder, as are well known in the art. If roll coating is desired, gravure rolls, lithographic rolls, etc. may be used. The oil (26) may be particularly applied to the second surface (22) of the sheet (20) in a uniform coating for simplicity of manufacture. Alternatively, the oil (26) may be applied to the second surface (22) of the sheet (20) in MD zones, as is known in the art.

Suitable waxes (25) include various types of hydrocarbons, as well as esters of certain fatty acids (e.g., saturated triglycerides) and fatty alcohols. They can be derived from natural sources (i.e., animal, vegetable or mineral) or can be synthesized. Mixtures of these various waxes (25) can also be used. Some representative animal and vegetable waxes (25) that can be used in the present invention include beeswax (25), carnauba, spermaceti, lanolin, shellac wax (25), candelilla, and the like. Representative waxes (25) from mineral sources that can be used in the present invention include petroleum-based waxes (25) such as paraffin, petrolatum and microcrystalline wax (25), and fossil or earth waxes (25) such as white ceresine wax (25), yellow ceresine wax (25), white ozokerite wax (25), and the like. Representative synthetic waxes (25) that can be used in the present invention include ethylenic polymers such as polyethylene wax (25), chlorinated naphthalenes such as "Halowax (25)," hydrocarbon type waxes (25) made by Fischer-Tropsch synthesis, and the like.

Adhesive polymers useful for the present invention can further include thermoplastic polymers such as A-B-A triblock copolymers, A-B diblock copolymers, A-B-A-B-A-B multiblock copolymers, radial block copolymers and grafted versions thereof; homopolymers, copolymers and terpolymers of ethylene; and homopolymers, copolymers and terpolymers of propylene; and mixtures thereof. Radial block copolymers include Y-block and star polymers as well as other configurations. The A-B-A block copolymers useful herein are those described in U.S. Pat. No. 4,136,699 issued Jan. 30, 1979 to Collins et al., which is incorporated herein by reference. Examples include those polymers available under the Kraton™ G series from Shell Chemical Co. of Houston, Tex. There are various grades of saturated A-B diblock/A-B-A triblock mixtures with ethylene/butylene midblocks; a high percent A-B diblock linear styrene-isoprene-styrene polymer; primarily A-B-A triblock linear styrene-isoprene-styrene block copolymers; a linear styrene-isoprene-styrene "SIS" block copolymer with an oil content of about 30% by weight and a high molecular weight styrene-buradiene-styrene "SBS" block copolymer both available from Shell Chemical Co.; A-B-A-B-A-B multiblock SBS block copolymers available from Firestone of Akron, Ohio; a linear SIS block copolymer available from Enichem Elastomers of New York, N.Y.; a linear styrene-isoprene-styrene block copolymer and a radial SBS block copolymer both also available from Enichem Elastomers; a linear SBS block copolymer available from Exxon Chemical Co. in Houston, Tex.; Vector™ fully coupled linear SIS block copolymers containing different weight percentages of styrene endblock; and a highly coupled linear SIS block copolymer also available from Exxon Chemical Co.; radial SIS block copolymers available from Dexco Polymers of Houston, Tex.

Other adhesive polymers include a substantially linear copolymer having the general configuration A-B-A. wherein the A block can be polystyrene and the B block can be ethylene-butylene, ethylene-propylene, isoprene, butadiene or mixtures thereof, and preferably the B block is ethylene-butylene or ethylene-propylene. Adhesive polymers of this type, such as Kraton™ G-1651, have twice the molecular weight of conventional styrene-ethylene/butylene-styrene (S-EB-S) block copolymers also used in pressure sensitive adhesives. This copolymer is typically present in amounts of from about 2% to about 20% by weight, preferably from about 5% to about 20%, by weight of the pressure sensitive adhesive.

Other adhesive polymers include lower molecular weight block copolymers that can be utilized with the high molecular weight block copolymers. Some examples are A-B-A triblock copolymers, A-B diblock copolymers, A-B-A-B-A-B multiblock copolymers, radial block copolymers, and grafted versions of such copolymers as disclosed in Collins et al. U.S. Pat. No. 4,136,699.

Other useful adhesive polymers include atactic polyalphaolefins such as those available from Rexene Products Co. of Dallas, Tex. under the tradename of Rextac™ and having various amounts of ethylene and homogeneous linear or substantially linear interpolymers of ethylene with at least one C2 to C20 alphaolefin, further characterized by each said interpolymer having a polydispersity less than about 2.5 including such polymers as an ethylene-butene copolymer, an ethylene-propylene copolymer, an ethylene-hexene copolymer, all available from Dow Chemical Co. of Midland, Mich. These polymers may have to be used in small concentrations if utilized with such block copolymers as Kraton™ G-1651 to maintain compatibility without phase separation or glutinous, gel-like compositions.

Other adhesive polymers can be useful in the hot melt of the present invention including ethylene vinyl acetate copolymers such as a 14% vinyl acetate/400 melt index copolymer and a 28% vinyl acetate/400 melt index copolymer, available from DuPont Chemical Co. of Wilmington, Del.; an ethylene vinyl acetate copolymer available from Exxon Chemical Co.; Copolymers of ethylene and methyl acrylate (methacrylates as well as acrylates) are also useful. Ethylene methyl acrylate copolymers are also available from Chevron under the tradename of Emac™ and from Quantum Chemical Co. under the tradename Acrythene™. Copolymers of ethylene and n-butyl acrylate are also useful in the pressure sensitive adhesives of the present invention. They are available from Quantum Chemical Co. under the tradename of Enathene™, from Elf Atochem North America under the tradename of Lotryl™ and from Exxon Chemical Co. under the tradename of Escorene™.

Suitable tackifying resins optionally added to hot melts in order to improve adhesion and introduce tack include, among other materials, (a) natural and modified resins, (b) polyterpene resins, (c) phenolic modified hydrocarbon resins, (d) coumarone-indene resins, (e) aliphatic and aromatic petroleum hydrocarbon resins, (f) phthalate esters and (g) hydrogenated hydrocarbons, hydrogenated rosins, and hydrogenated rosin esters. Tackifying resins in hot melt adhesives that are solid at room temperature, but melt below application temperatures are preferred, since these resins lower the viscosity on application resulting in improved distribution and anchoring of the adhesive to the substrate, while not having excessive fluidity at ambient temeprature during usage. Preferably, these resins have a melting point between about 35° C. and about 200° C., more preferably between about 50° C. and about 150° C.

The tackifying resins useful herein further include aliphatic, cycloaliphatic and aromatic hydrocarbons and modified hydrocarbons and hydrogenated derivatives; terpenes and modified terpenes and hydrogenated derivatives; rosins and modified rosins and hydrogenated derivatives; and mixtures thereof.

They are also available with differing levels of hydrogenation, or saturation which is another commonly used term. Useful examples include Eastotac™ from Eastman Chemical Co. of Kingsport, Tenn., which are partially hydrogenated cycloaliphatic petroleum hydrocarbon resins with varying degress of hardness. There are numerous types of rosins and modified rosins available with differing levels of hydrogenation including gum rosins, wood rosins, tall-oil rosins, distilled rosins, dimerized rosins and polymerized rosins. Some specific modified rosins include glycerol and pentaerythritol esters of wood rosins and tall-oil rosins. Commercially available grades include, but are not limited to, a pentaerythritol rosin ester available from Arizona Chemical Co., a pentaerythritol rosin ester from Union Camp of Wayne, N.J., a glycerol ester of tall oil rosin from Arizona Chemical Co., a pentaerythritol modified wood rosin available from Hercules, Inc. of Wilmington, Del. and a highly hydrogenated pentaerythritol rosin ester available. Various endblock resins are also useful in the compositions of the present invention. These include an aromatic hydrocarbon, and alphamethyl styrene hydrocarbons manufactured by Hercules, Inc.

While completely formulated hot melts are useful in the present invention, it was found that single components used in hot melt mixtures can also be effective. For example tacky adhesive polymers selected from the group consisting of: polyisobutylene polymers, alkyl methacrylate polymers, polyalkyl acrylates, and mixtures thereof, wherein the alkyl groups are $C_2$-$C_{18}$, preferably $C_2$-$C_{12}$. Preferred tacky polymers are poly n-decyl methacrylate, poly ethyl acrylate, poly n-butyl acrylate, and mixtures thereof. More preferred tacky polymers herein are polyisobutylene polymers.

Preferably the wax (25) is impermeable to penetration and permeation of oil (26) therethrough. Such impermeability provides the benefit that oil (26) disposed on the opposing surface of the sheet (20) does not penetrate through the thickness of the sheet (20) and contact the target surface. Without being bound by theory it is believed that excessive contact of oil (26) with the target surface leaves residue thereon. Residue is undesirable as it can attract more debris and leave a sticky tactile sensation. Likewise, the wax (25) should not exhibit cohesive failure in use, and leave residue on the target surface, or create undue friction in use. Further the wax (25) may desirably reduce the number of free fibers which dislodge from the sheet (20) during use. The wax may have an ASTM D1321 penetration value of 20 to 100 dmm Likewise, the wax (25) may be applied to the first surface (21) of the sheet (20), the second surface (22) of the sheet (20) or both surfaces of the sheet (20), using a sprayer, roll coater or slot extruder, as are well known in the art. If roll coating is desired, gravure rolls, lithographic rolls, etc. may be used. The wax (25) may be particularly applied to the first surface (21) of the sheet (20) in a uniformly patterned coating for simplicity of manufacture.

While not limited to theory the inventors believe that a certain percentage of wax (25) and/or other fixed solidified coating (25) on the first surface (21) of the sheet (20) is preferred. If the wax (25) is too concentrated it can further lead to cohesive failure or cause excess adhesion of sheet (20) making it difficult use. In the preferred embodiment the wax (25) has an add-on level from about 0.1 to about 25%, more preferably from about 0.5 to about 20%, more preferably from about 1 to about 15%, still more preferably from about 3 to about 10%, still more preferably from about 4 to about 8%, and most preferably from about 4 to about 6%, by weight. It is understood that if tackier coatings are used the preferred add-on range is less. It is believed that surface area of sheet about 25% to about 90%, preferably about 40% to about 75%, of the sheet (20) may be covered with wax (25).

By uniformly patterned it is meant that the first surface (21) is textured with peaks (27) and valleys (28) and the wax (25) is applied to the peaks (27) of the first surface (21). While the wax (25) may also be applied to the valleys (28) of the first surface (21), it is preferred that the wax (25) be only applied to the peaks (27). The wax (25) may be applied using two rolls and a nip therebetween. The sheet (20) is run through the nip in known fashion and the wax (25) applied specifically to the peaks (27) on the first surface (21). Wax (25) may be, but is preferably not, applied to the valleys (28) on the first surface (21) of the sheet (20).

The wax (25) may have a thickness of 0.01 to 0.25 mm. The wax (25) may have fast curing or crystallization at room temperature to adequately promote fixation of the wax (25), particularly on the peaks (27) of the first surface (21) of the sheet (20). In an alternative embodiment a slower curing coating such as latex or solvent based pressure sensitive adhesive could be applied to the peaks (27) and then rapidly cured with heat, UV, and other external curing. It is understood that wax (25) would be applied and cured as first step prior to applying oil (26) on the opposite side of sheet (20).

If a mixture of mineral oil (26) and wax (25) is utilized, a ratio of oil (26) to wax (25) of from about 1:99 to about 7:3, preferably from about 1:99 to about 1:1, more preferably from about 1:99 to about 3:7, by weight may be used. A preferred mixture is a 1:1 mixture of mineral oil (26) and paraffin wax (25). The coating on the sheet (20) may also include perfumes, pest control ingredients, antimicrobials, fungicides, and other ingredients.

In a particularly preferred embodiment, a sheet (20) having a textured first side and flat second side opposed thereto is used. The first side of the sheet (20) has uniformly patterned wax (25) disposed on the peaks (27), but not on the valleys (28). The pattern on the first surface (21) of the sheet (20) may be continuous or discontinuous. The second side of the sheet (20) has oil (26) disposed thereon. Preferably the oil (26) is uniformly disposed throughout the second surface (22), although the oil (26) may also be disposed in any desired continuous or discontinuous pattern. Preferably the wax (25) pattern on the first surface (21) and oil (26) pattern on the second surface (22) are not coincident.

This arrangement provides the benefit that the oil (26) which penetrates through the thickness of the sheet (20) from the second surface (22) towards the first surface (21) reaches the valleys (28) of the first surface (21). But oil (26) is blocked from reaching the peaks (27) of the first surface (21) by the wax (25). Thus, oil (26) is disposed in the valleys (28) of the first surface (21), but not on the peaks (27) of the first surface (21) coated with the wax (25).

This disposition is believed to provide the benefit that oil (26) in the valleys (28) collects and retains debris accumulated from the target surface. But the oil (26) does not directly or excessively contact the target surface, minimizing deposition of residue thereon. The wax (25) does directly contact the target surface, and provides for collection and retention of debris therefrom.

The inventors have discovered that by using different coatings (25)(26)on opposite surfaces (21)(22) of the sheet (20) synergistic benefits can be seen. In the preferred embodiment one side (21) of the sheet preferably the lower side that would contact the target surface would utilize a coating (25) that at room temperature is a fixed solid. The exemplary preferred coatings (25) include synthetic waxes, natural waxes, hydrophobic & hydrophilic waxes, wax oil mixtures, hot melt adhesives, hot melt adhesive/oil mixtures, water base pressure sensitive adhesives and mixtures thereof. On the second surface (22) of the sheet (20) which is away from the cleaning surface the preferred coating (26) is essentially free flowing and preferably a liquid at room temperature. The preferred coatings (26) for the second surface (22) include synthetic oils, natural oils, glycerin, low VOC solvents, water based pressure sensitive adhesives and mixtures thereof.

The wax (25) is disposed on the first surface (21) in any desired pattern. As used herein wax (25) includes various fixed solidified coatings (25) and particularly includes any coating that after curing remain in a solidified state at room temperature conditions (25 degrees C.). The wax (25) may be sprayed or printed to provide a continuous coating with discrete uncoated regions. Or the wax (25) may be disposed in a discontinuous pattern with discrete uncoated regions. The oil (26) is disposed on the second surface (22) of the sheet (20). The oil (26) may be disposed in a continuous pattern with no uncoated region. Or the oil (26) may be disposed on the second surface (22) of the sheet (20) in any desired continuous or discontinuous pattern.

While applying one type of wax (25) to the peaks (27) of the first surface (21) of the sheet (20) is a preferred embodiment, the invention optionally could apply a second and different wax (25) on the same first surface (21) in different location, creating zone coating. For example wax (25) could be applied to the peaks (27) of the first surface (21) and then tackier hot melt (25) or other adhesive (25) could be applied in the valleys (28). Since not all the valleys (28) will be covered, there is still advantage to apply oil (26) to second surface side (22). In yet another embodiment a sheet (20) could be designed to have peaks (27) and/or valleys (28) at different depths. This type of sheet (20), having one or more different waxes (25) on first surface (21) and one or more different oils (26) on the second surface (22) may offer further synergistic advantages such as tailoring different coatings (25)(26) to different debris, surfaces and cleaning tasks.

The wax (25) or oil (26) may be printed in known fashion in a pattern or as a uniform coating. Letterpress printing, involves wax (25), oil (26) or equivalent material being applied to the top of a raised surface. This surface is pressed against the sheet (20), thus transferring the material to the sheet (20). Flexographic printing uses a printing plate, often cylindrical, made of rubber, plastic, or other flexible material. Wax (25), oil (26) or equivalent material is applied to a raised image on the plate. The plate is then placed in contact with the sheet (20), and wax (25), oil (26) or equivalent material is transferred to the sheet (20).

Gravure printing uses a print cylinder having depressions of varying depths that are etched into the cylinder. This method of printing is performed by partially immersing the etched cylinder into an enclosed fountain or trough of wax (25), oil (26) or equivalent material. The etched cells, which produce the image, are filled with wax (25), oil (26) or equivalent material, and the surface the cylinder also becomes coated with wax (25), oil (26) or equivalent material. Since the surface of the cylinder is non-image producing, wax (25), oil (26) or equivalent material is not desirable on the cylinder surface. This undesired wax (25), oil (26) or equivalent material is removed by a doctor blade or knife which wipes all of the surface wax (25), oil (26) or equivalent material from the cylinder. As the printing cylinder comes in contact with the sheet (20), the wax (25), oil (26) or equivalent material contained within the cells is transferred to the sheet (20). Gravure is ideal for continuous printing operations and the printing of very long runs. Generally, solvent-based wax (25), oil (26) or equivalent materials are used in gravure printing.

Lithographic printing, or offset lithography, is a printing method that utilizes surface characteristics on an image carrying offset plate. Offset plates are typically made from a thin paper, plastic, or a metal sheet (20) which once exposed and processed can be wrapped around a cylinder of a press for printing. The offset plate contains two areas: an image area that is hydrophobic and a non-image area that is hydrophilic. While the basic principle is common, there are many differences between offset plates and the method they use to separate the image from the non-image areas. Generally, wax (25), oil (26) or equivalent material adheres to the hydrophobic image area while being repelled from the hydrophilic non-image area. The wax (25), oil (26) or equivalent material and watered offset plate may be printed on a second cylinder usually coated in rubber. The second cylinder then off-sets this wax (25), oil (26) or equivalent material and water impression onto the sheet (20).

Screen printing utilizes a porous screen made from silk or other polymeric material. The screen is attached to a frame. A stencil is produced on the screen either photo-mechanically or manually. The non-printing areas are protected by the stencil. Printing is done on the sheet (20) under the screen by applying a viscous wax (25), oil (26) or equivalent material to the screen. The wax (25), oil (26) or equivalent material is forced through the fine openings of the screen with a rubber squeegee or roller.

Inkjet printing is a non-impact dot-matrix technology where wax (25), oil (26) or equivalent material droplets are jetted from a small aperture directly to specified positions on a medium to create an image. Inkjet printing may be done on a continuous method or a drop-on-demand method. Continuous inkjet printing involves a continuous stream of wax (25), oil (26) or equivalent material droplets. Generally, the wax (25), oil (26) or equivalent material droplets may be charged by a charge electrode. If the droplets are not charged, the droplet travels directly to the sheet (20) through and unimpeded by a voltage carrying plate. Droplets that are charged are deflected by the voltage carrying plate. If diverted, the droplet is captured and recirculated prior to reaching the sheet (20). Another continuous inkjet method charges all droplets and the voltage plate controls droplet placement onto the sheet (20) or diversion. Drop-on-demand inkjet printing, as the name implies, provides a droplet only when needed. Droplets are formed by a variety of methods with thermal and piezoelectric drop formation being most common. Thermal inkjet printing involves the wax (25), oil (26) or equivalent material droplets being expelled from a nozzle by the rapid expansion of a vapor bubble created by a small heater. Piezoelectric inkjet printing involves the droplets being expelled from a nozzle by a pressure wave created from the expansion of a piezoelectric ceramic upon application of a voltage. Inkjet printing techniques are well known in the art as described in Hue. P. Le, *Progress and Trends in Ink-Jet Printing Technology,* Journal of Imagining Science and Technology, Vol. 42, pages 49-62.

The sheet (20) according to the present invention may be executed as a dry cleaning sheet (20) for cleaning floors, etc. The cleaning sheet (20) according to the present invention may be used with a stick-type cleaning implement. The cleaning implement may comprise a plastic head for holding the cleaning sheet (20) and an elongate handle (40) articulably connected thereto. The handle (40) may comprise a metal or plastic tube or solid rod.

The head may have a downwardly facing surface, to which the sheet (20) may be attached. The downwardly facing service may be generally flat, or slightly convex. The head may further have an upwardly facing surface. The upwardly facing surface may have a universal joint to facilitate connection of the elongate handle (40) to the head.

The upwardly facing surface may further comprise a mechanism, such as resilient grippers, for removably attaching the cleaning sheet (20) to the implement. Alternatively, a hook and loop system may be used to attach the cleaning sheet (20) to the head. If grippers are used with the cleaning implement, the grippers may be made according to commonly assigned U.S. Pat. Nos. 6,305,046; 6,484,346; 6,651,290 and/or D487,173.

If desired, the cleaning implement may have an axially rotatable beater bar and/or vacuum type suction to assist in removal of debris from the target surface. Debris removed from the target surface may be collected in a dust bin. The dust bin may be mounted within the head, or, alternatively, on the elongate handle.

A suitable stick-type cleaning implement may be made according to commonly assigned U.S. Pat. Nos. Des. 391,715; D409,343; D423,742; D481,184; and/or D588,770. A suitable vacuum type cleaning implement may be made according to the teachings of U.S. Pat. Nos. 7,137,169, D484,287 S, D615,260 S and D615,378 S. An implement having a beater bar may be made according to commonly assigned US 2013/0333129. A motorized implement may be made according to commonly assigned U.S. Pat. No. 7,516,508.

Figure 2A:
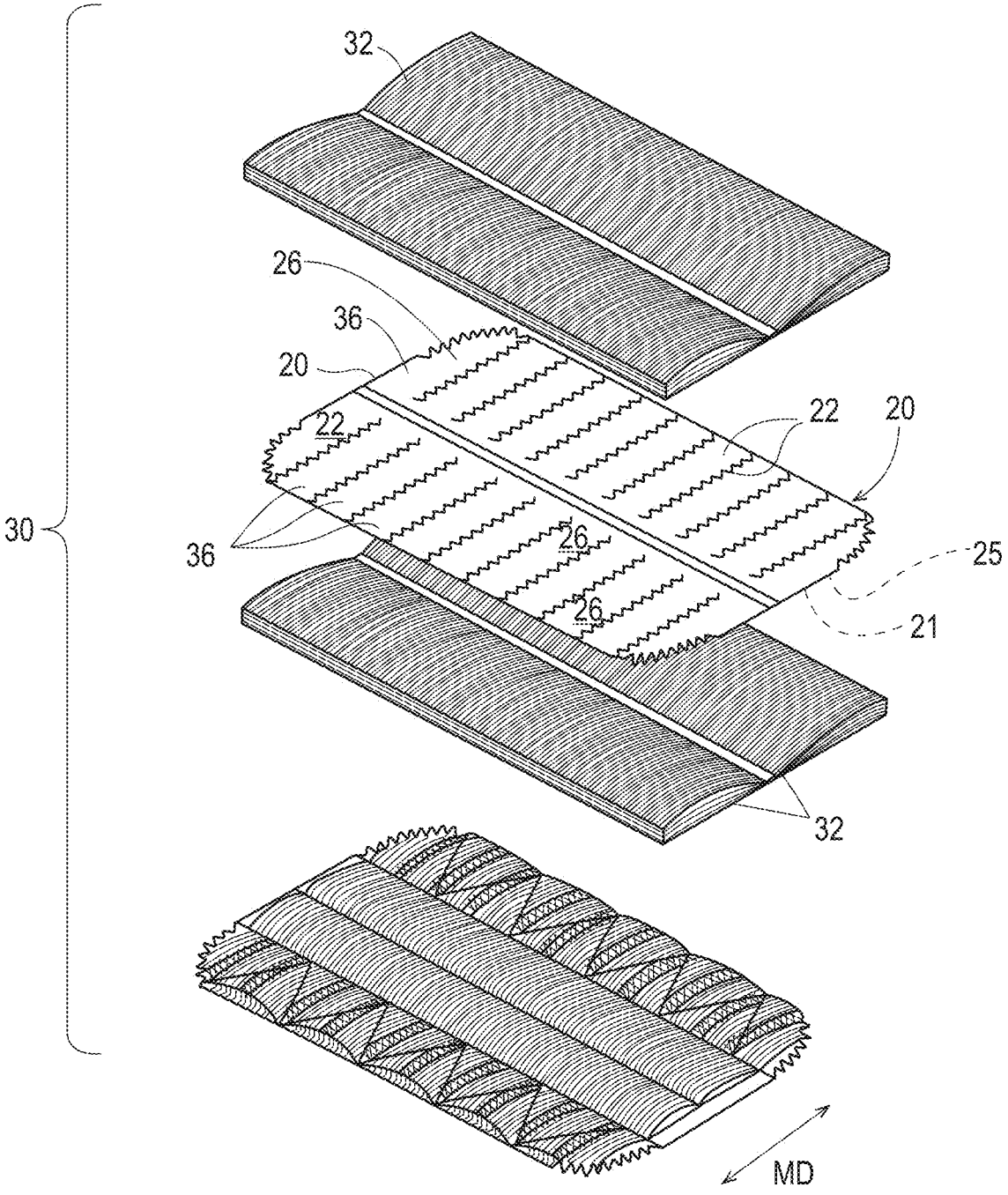
FIG. 2A is a schematic exploded perspective view of a duster according to the present invention having strips.
Figure 2B:
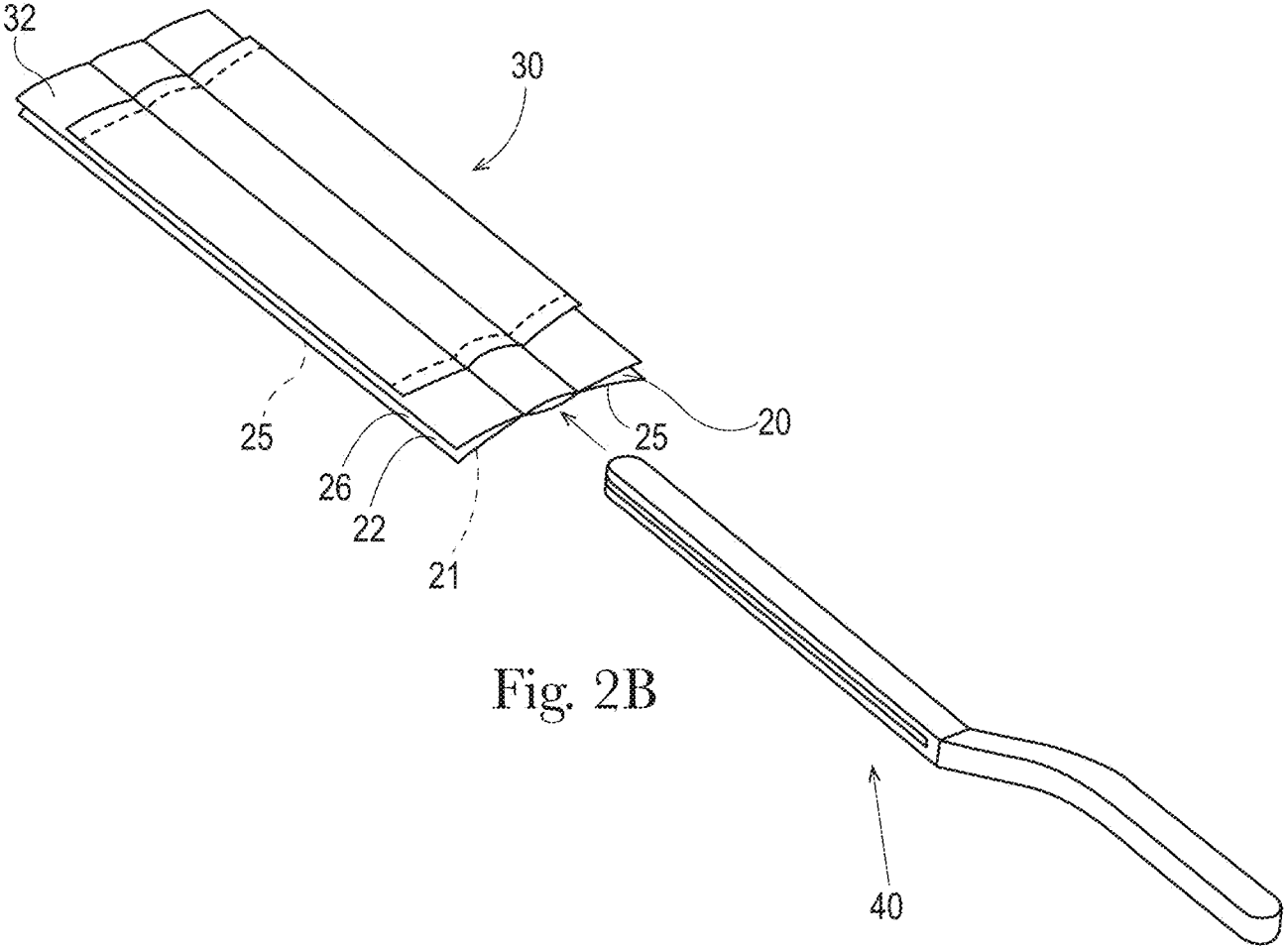
FIG. 2B is a schematic exploded perspective view of a duster without strips and a handle therefor.

Referring to FIGS. 2A-2B, alternatively, the cleaning sheet (20) according to the present invention may be executed as a duster (30). A duster (30) may comprise a cleaning article having a nonwoven sheet (20) according to the present invention and tow fibers (32) joined thereto. The cleaning article may have a longitudinal axis. The tow fibers (32) may be joined to the nonwoven sheet (20) in a generally transverse direction and particularly in a direction normal the longitudinal axis, to provide a laminate structure of two laminae.

If desired, the cleaning article may comprise additional laminae. For example, the tow fibers (32) may be disposed intermediate two nonwoven sheets (20). Plural laminae of tow fibers (32) may be disposed intermediate the nonwoven sheets (20) and/or outboard thereof. The sheets (20) may be provided without strips (36). Optionally, one or more of the nonwoven sheets (20) may be cut to provide comprise strips (36). The strips (36) may be generally normal to the longitudinal axis. The cleaning article may be made according to U.S. Pat. No. 6,813,801 and according to commonly assigned U.S. Pat. Nos. 7,803726; 8,756,746; 8,763,197 and 8,931,132.

The laminae of the cleaning article may be joined together using adhesive, thermal bonding, ultrasonic welding, etc. If desired, the bonding lines may be generally parallel to the longitudinal axis and may be continuous, or discontinuous as desired. Three longitudinally parallel bonding lines may be utilized to define two sleeves.

The two sleeves may accept one or more complementary fork tines of a handle. The fork tines may be removably inserted into the sleeves of the cleaning article to provide for improved ergonomics. The handle (40) may be plastic and made according to the teachings of U.S. Pat. Nos. 7,219,386; 7,293,317, 7,383,602 and/or commonly assigned U.S. Pat. No. 8,578,564.

Average Height Differential

Average Height Differential is determined using a light microscope (e.g., Zeiss Axioplan, Zeiss Company, Germany) equipped with a Z-dimension measuring device (e.g., Microcode II, sold by Boeckeler, Instruments). This procedure involves locating a peak (27) or valley (28) region of the sheet (20), focusing the microscope and zeroing the Z-dimension measuring device. The microscope is then moved to an adjacent valley (28) or peak (27) region, respectively, and the microscope is refocused. The display of the instrument indicates the height difference between this peak (27)/valley (28) or valley (28)/peak (27) pair. This measurement is repeated at least 10 times, at random locations on the sheet (20), and the Average Height Differential is the average of these measurements.

EXAMPLES

A flat 50 gsm flat nonwoven sheet (20) from Avgol Ltd. of Mocksville, N.C. was treated as shown in Table 1 below. The sheets (20) in Table 1 were then tested on 13.5 square meter wood test floor using a commercially available Swiffer Sweeper sold by the instant assignee. The control sheet (20) in Trial 1 had no coating. The sheets (20) in Trials 2 and 3 had wax (25) and oil (26) coatings, respectively. Trial 4 was a sheet (20) according to the invention. The percentage of test debris collected was measured as retained on the sheet (20) after cleaning.

Figure 3:
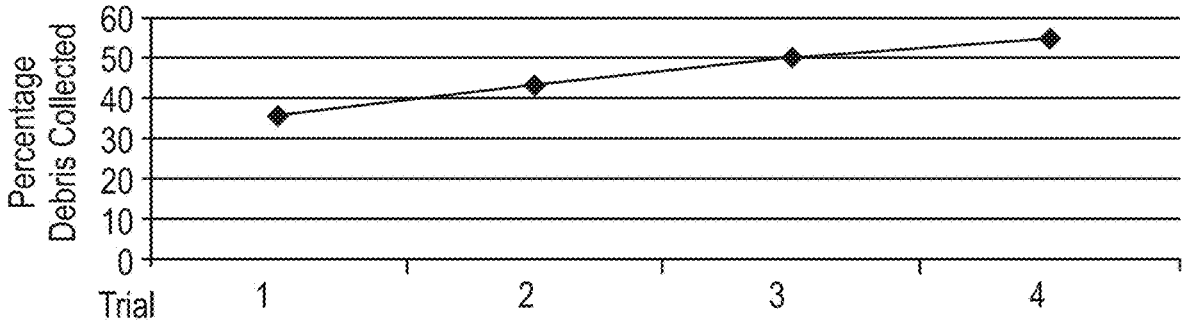

Referring to FIG. 3, it is seen that a generally linear relationship occurs. However, the sheet (20) according to the present invention was observed to not only improve in debris pickup, but also advantageously demonstrated reduced residue deposition with a flat sheet (20).

TABLE 1

| Trial | Coating | Percentage debris collected | Difference vs. Control |
|---|---|---|---|
| 1 | No coating on first surface or second surface. | 36 | Control |
| 2 | 100 mg microcrystalline wax on first surface. | 44 | 22% |
| 3 | 500 mg mineral oil on first surface. | 51 | 42% |
| 4 | 100 mg microcrystalline wax on first surface and 500 mg mineral oil on second surface. | 57 | 58% |

Referring to Table 2, two textured nonwoven sheets (20) were tested. The sheets (20) were taken from Swiffer Sweeper Dry sheets (20) sold by the instant assignee. A control sheet (20) was prepared having wax (25) on the first surface (21) of the sheet (20) in Trial 1. A sheet (20) according to the present invention was also prepared using the same sheet (20) for Trial 2. The sheets (20) were tested using the same protocol as described above with respect to Table 1.

Figure 4:
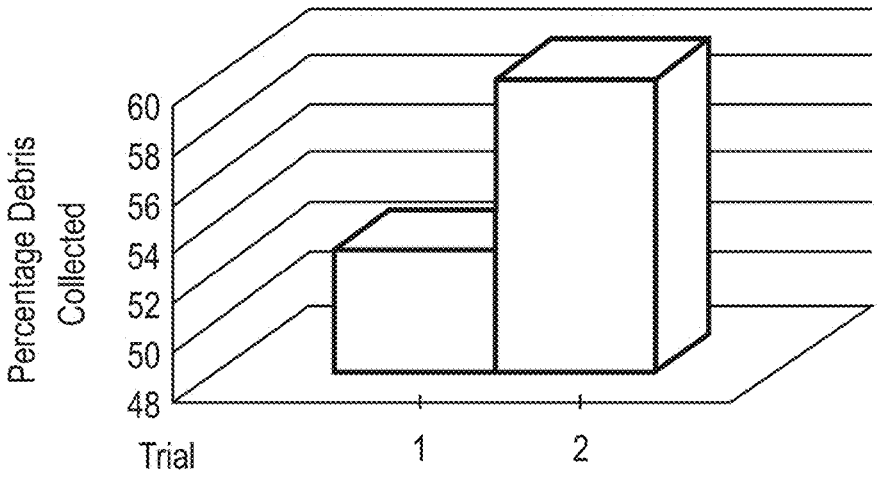

Referring to FIG. 4, it can be seen that the textured sheet (20) according to the present invention advantageously exhibited 7% greater debris collection than the control sheet (20), a 13% improvement over the control sheet (20).

TABLE 2

| Trial | Coating | Percentage debris collected |
|---|---|---|
| 1 | 35 mg microcrystalline wax on first surface. | 53 |
| 2 | 35 mg microcrystalline wax on first surface. 500 mg mineral oil on second surface. | 60 |

Referring to Table 3, four dusters (30) of the type sold by the instant assignee as Swiffer Dusters (30) were tested. Each duster (30) had approximately 28 strips (36) on a bottom nonwoven sheet (20), with 14 strips (36) disposed symmetrically opposite on each side of the duster (30). The bottom sheet (20) was coated as shown in Table 3.

Figure 5:
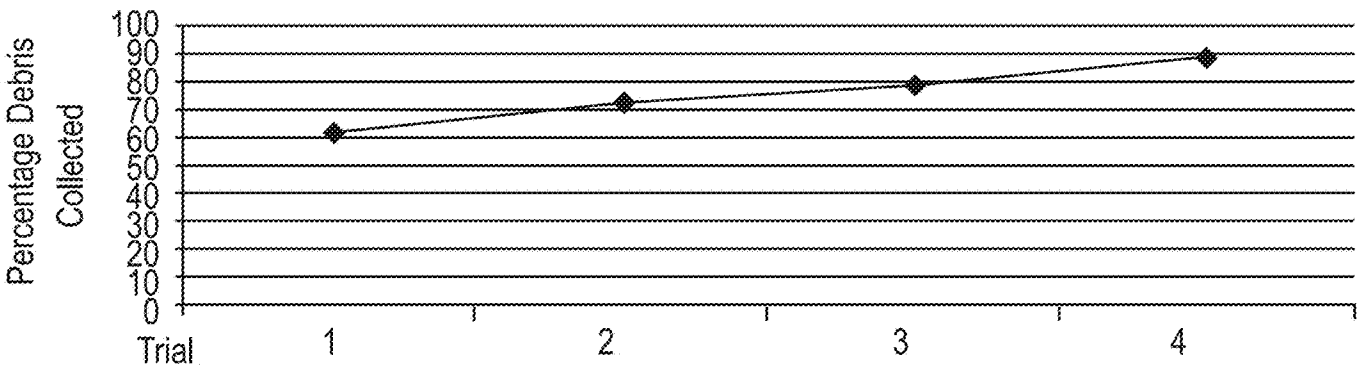

Referring to FIG. 5, it can be seen that Trials 2 and 3 exhibited 16 and 26% improvement over the control in Trial 1, respectively. Trial 4 was a sheet (20) on a duster (30) according to the present invention. It can be seen that Trial 4 exhibited the aggregate improvement over the control of Trials 2 and 3 combined. But Trial 4 demonstrated less residue than Trials 2-3.

TABLE 3

| Trial | Coating | Percentage debris collected | Difference vs. Control |
|---|---|---|---|
| 1 | No Coating | 62 | Control |
| 2 | 40 mg mg microcrystalline wax on first surface. | 72 | 16% |
| 3 | 175 mg mineral oil on first surface. | 78 | 26% |
| 4 | 40 mg mg microcrystalline wax on first surface. 175 mg mineral oil on second surface. | 88 | 42% |

Referring to Table 4, two dusters (30) of the type sold by the instant assignee as Swiffer Dusters (30) were tested. Again each duster (30) had approximately 28 strips (36) on a bottom nonwoven sheet (20), with 14 strips (36) disposed symmetrically opposite on each side of the duster (30), and coated as shown in Table 4. These dusters (30) also had two superimposed nonwoven sheets (20) on the top of the duster (30). These sheets (20) each had approximately 28 strips (36), disposed 14 symmetrically opposite on each side of the duster (30) and coated as shown in Table 4. Only the top sheet (20) of the two nonwoven sheets (20) on the top was coated as described in Table 4. The debris collections were separately recorded for the top sheet (20) and bottom sheet (20).

Figure 6:
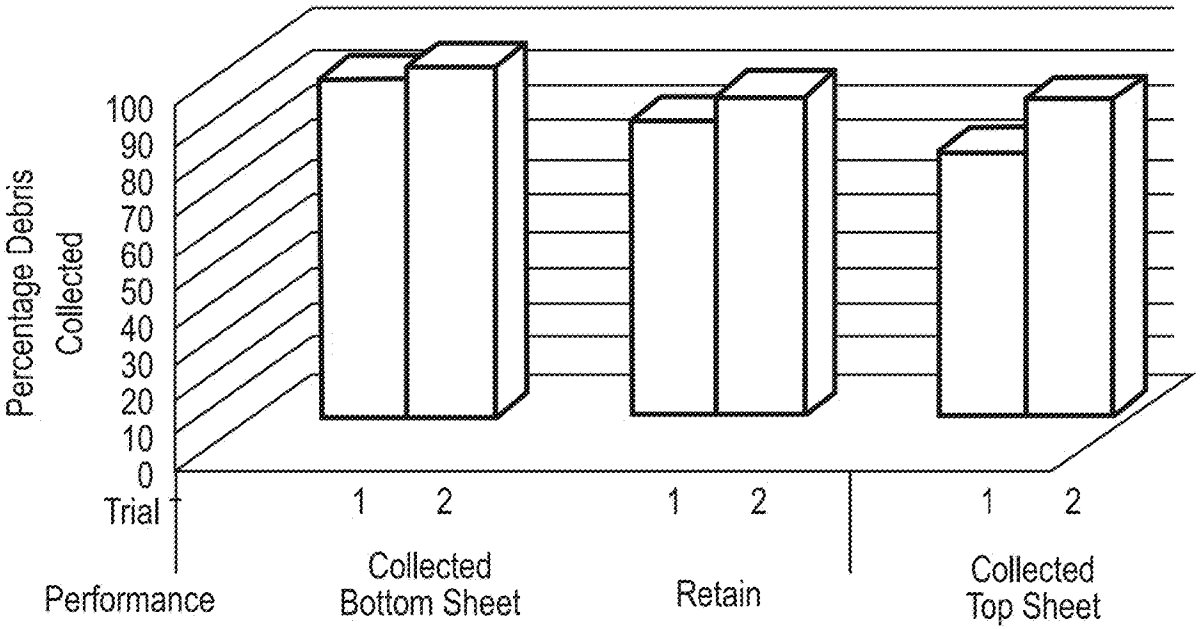

Referring to FIG. 6, it can be seen that providing a sheet (20) according to the present invention on either the top or bottom of the duster (30) improves debris collection, again without leaving residue.

TABLE 4

| Trial | Coating bottom sheet strips/ Coating top sheet strips | Percentage debris bottom sheet/Percentage debris top sheet | Trial |
|---|---|---|---|
| Trial 1 | No coating on the first surface, 175 mg oil on the second surface/ No coating on either surface. | 82/51 | Trial 1 |
| Trial 2 | 40 mg wax on first surface 175 mg oil on second surface/ 40 mg wax on first surface 175 mg oil on second surface | 89/67 | Trial 2 |

Figure 7A:
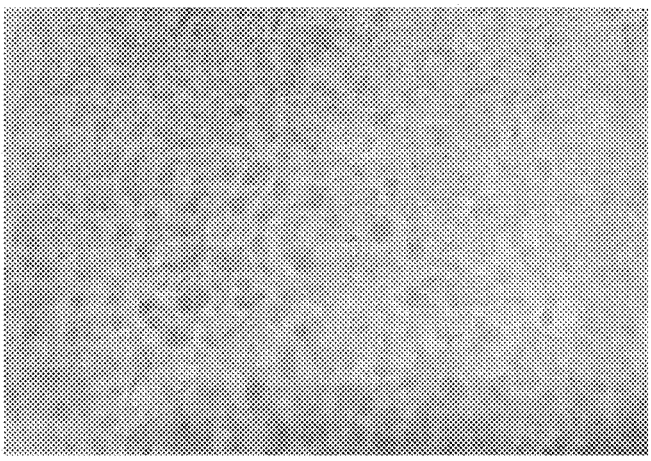
FIGS. 7A and 7B are frontal photographs of the first surfaces of a textured sheet and flat sheet, respectively, having mineral oil applied to the first surfaces thereof.
Figure 7B:
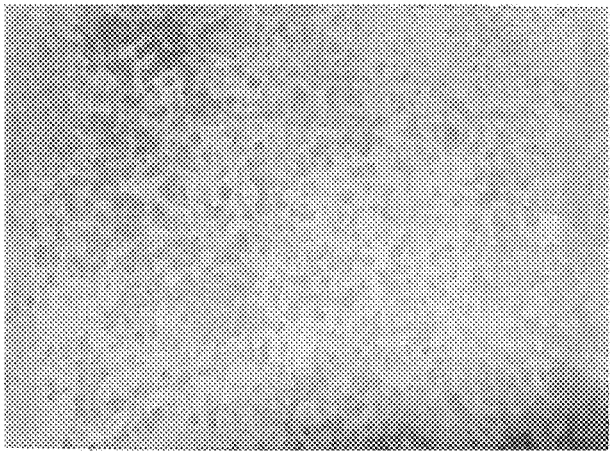
Figure 8A:
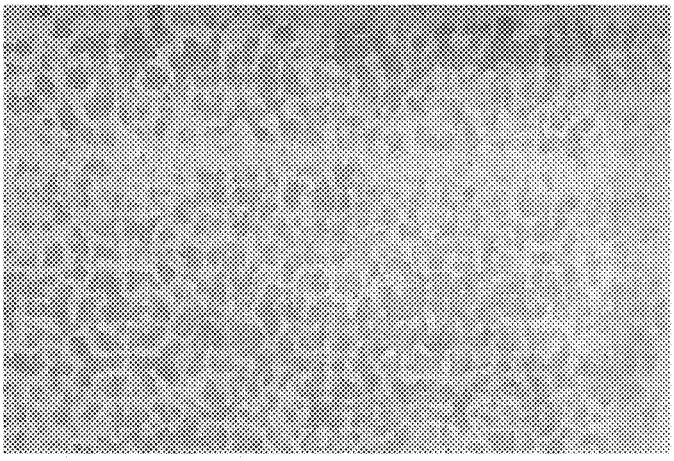
FIGS. 8A and 8B are frontal photographs of the first surfaces of a textured sheet and flat sheet, respectively, having mineral oil applied to the second surfaces thereof.
Figure 8B:
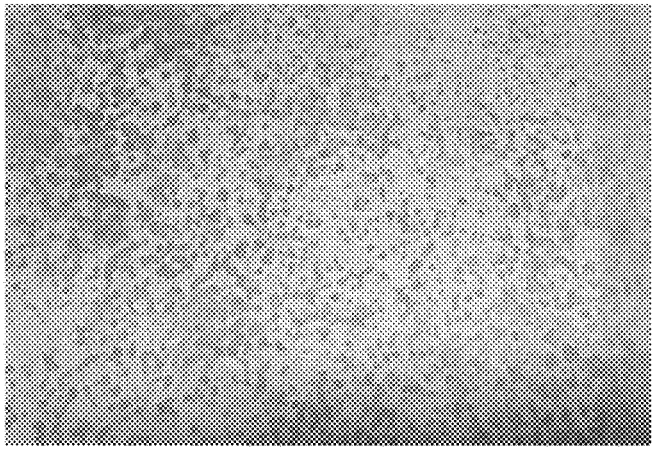
Figure 9A:
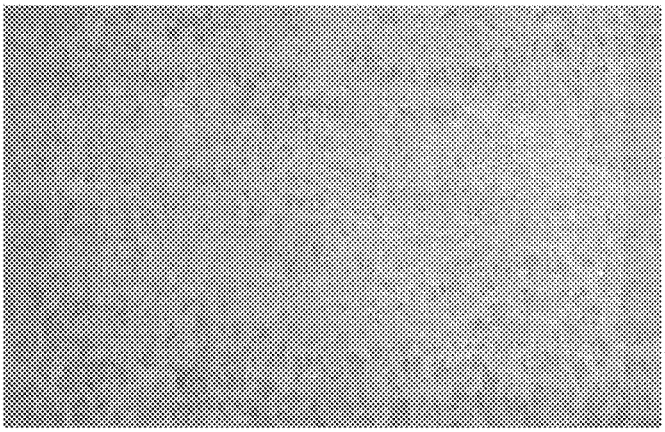
Figure 9B:
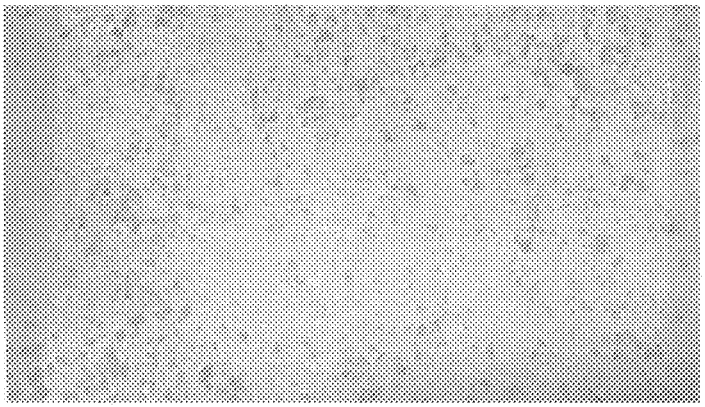

Referring to FIGS. 7A-9B, textured sheets (20) are shown in FIGS. 7A, 8A and 9A. The textured sheets (20) are of the type sold by the instant assignee as Swiffer Sweeper Dry sheets (20). Flat sheets (20) are shown in FIGS. 7B, 8B and 9B. The flat sheets (20) are the 50 gsm Avgol Ltd. sheets (20) described above. Mineral was applied to each of these sheets (20), as described below. The darker regions of the sheets (20), as highlighted by an arrow in each of FIGS. 7A-9B, indicate regions having relatively greater concentrations of mineral oil (26).

Referring to FIGS. 7A-7B, mineral oil (26) was uniformly applied to the first surfaces (21) of the respective sheets (20). These sheets (20) show considerable darkening, indicating migration of the mineral oil (26) throughout the sheets (20).

Referring to FIGS. 8A-8B, mineral oil (26) was uniformly applied to the second surfaces (22) of the respective sheets (20). These sheets (20) show less darkening, still indicating migration of the mineral oil (26) throughout the sheets (20). The pattern of the textured sheet (20) is clearly visible in FIG. 8A.

Referring to FIGS. 9A-9B, wax (25) applied to the peak (27)s of the first surface (21) of the textured sheet (20) and uniformly throughout the first surface (21) of the flat sheet (20). Mineral oil (26) was uniformly applied to the second surfaces (22) of the respective sheets (20). These sheets (20) show even less darkening than any of the control sheets (20) shown in FIGS. 7S-8B. The front surface of FIG. 9A shows the peaks (27) generally have less oil (26) thereon, indicating the wax (25) prevents the oil (26) from reaching the peaks (27) on the first surface (21) and prophetically reducing deposition of residue which retaining debris collected from the target surface. FIG. 9B likewise shows very little bleedthrough of the oil (26). Bleedthrough which does occur is generally limited to small speckles, prophetically reducing deposition of residue which retaining debris collected from the target surface.

FIGS. 9A-9B visually show the unpredicted benefits of the claimed invention over the control sheets (20). FIGS. 3-6 graphically show the unpredicted benefits of the claimed invention over the control sheets (20).

Combinations

A. A textured sheet (20), said sheet (20) comprising nonwoven fibers and having:

a first outwardly facing surface and a second outwardly facing surface opposed thereto, said first outwardly facing surface having a plurality of peaks (27) and a plurality of valleys (28) thereon;

wax (25) disposed on said peaks (27) of said first surface (21); and oil (26) disposed on said second surface (22) of said sheet (20).

B. A textured sheet (20) according to paragraph A wherein said plurality of valleys (28)s do not have wax (25) disposedthereon.

C. A textured sheet (20) according to paragraphs A and B wherein oil (26) is uniformly disposed on said second surface (22).

D. A textured sheet (20) according to paragraphs A, B and C wherein said oil (26) comprises mineral oil (26).

E. A textured sheet (20) according to paragraphs A, B, C and D wherein said oil (26) is disposed 1-15 weight percent add on.

F. A textured sheet (20) according to paragraphs A, B, C, D, and E wherein said oil (26) has a viscosity of 10 to 500 centipoise.

G. A textured sheet (20) according to paragraphs, A, B, C, D, E and F wherein said wax is disposed in a discontinuous pattern.

H. A textured sheet (20) according to paragraphs, A, B, C, D, E, F, and G wherein said wax (25) comprises microcrystalline wax (25).

I. A textured sheet (20) according to paragraphs A, B, C, D, E, F, G and H wherein said first surface (21) has an average height differential of 0.5 to 6 mm.

J. A textured sheet (20) according to paragraphs A, B, C, D, E, F, G, H and I wherein said second surface (22) is flat.

K. A nonwoven sheet (20), said sheet (20) comprising:

a first outwardly facing surface and a second outwardly facing surface opposed thereto, wax (25) disposed in a wax (25) pattern on said first surface (21); and oil (26) disposed in an oil (26) pattern on said second surface (22); said oil (26) pattern not being coincident said wax (25) pattern.

L. A nonwoven sheet (20) according to paragraph K having a 5 to 25 weight % oil (26) disposed thereon and 1 to 10 weight % wax (25) disposed thereon.

M. A nonwoven sheet (20) according to paragraphs, K and L wherein wax (25) is disposed in a discontinuous pattern and said oil (26) is disposed in a continuous pattern.

N. A duster (30), said duster (30) comprising:

at least one layer of tow fibers (32);

a first nonwoven sheet (20) joined thereto, said nonwoven sheet (20) having a first outwardly facing surface and a second surface (22) opposed thereto, said second surface (22) being oriented towards said tow fibers (32);

wax (25) disposed in a wax (25) pattern on said first surface (21); and oil (26) disposed in an oil (26) pattern on said second surface (22); said oil (26) pattern not being coincident said wax (25) pattern.

O. A duster (30) according to paragraph N wherein said sheet (20) is textured, with a pattern of peaks (27) and valleys (28) disposed on said first surface (21), said wax (25) being disposed on said peaks (27).

P. A duster (30) according to paragraphs N and O wherein said sheet (20) is flat and said oil (26) is uniformly coated on said second surface (22) in a continuous pattern.

Q. A duster (30) according to paragraphs, N, O and P wherein said layer of tow fibers (32) has a first side oriented towards said nonwoven and a second surface (22) opposed thereto, said duster (30) further comprising a second nonwoven sheet (20) and third nonwoven sheet (20) disposed in facing relationship and bonded together to define two sleeves therebetween, said sleeves being adapted to receive a handle (40) therein, said second nonwoven sheet (20) being disposed on said second surface (22) of said layer of tow fibers (32).

R. A duster (30) according to paragraphs N, O, P, and Q wherein said sheet (20) is textured, with a pattern of peaks (27) and valley (28)s disposed on said first surface (21), said wax (25) being disposed on said peaks (27) of said first surface (21).

S. A duster (30) according to paragraphs N, O, P, Q and R wherein said first nonwoven sheet (20) comprises strips (36).

T. A duster (30) according to paragraphs N, O, P, Q, R and S wherein said second nonwoven sheet (20) comprises strips (36).

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm" and a pressure disclosed as "about 1100 kPa" is intended to include 1103.2 kPa.

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern. All limits shown herein as defining a range may be used with any other limit defining a range. That is the upper limit of one range may be used with the lower limit of another range, and vice versa.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A textured sheet, said sheet comprising nonwoven fibers and having:

a first outwardly facing surface and a second outwardly facing surface opposed thereto, said first outwardly facing surface having a plurality of peaks and a plurality of valleys thereon;

wax disposed on said plurality of peaks of said first surface in a discontinuous pattern; and oil disposed on said second surface of said sheet in a discontinuous pattern, wherein said oil has a viscosity of 10 to 100 centipoise at 20° C., wherein said first surface has an average height differential of 1 to 3 mm and said second surface is flat, wherein said oil is disposed at 1 to 15%, by weight of sheet and said wax is disposed at 1 to 10%, by weight of sheet, wherein said oil comprises mineral oil and said wax comprises microcrystalline wax, wherein the oil and wax are a 1:1, by weight, mixture, wherein said wax being disposed on said peaks, said oil being disposed in said valleys of said first surface and not on said peaks of said first surface with said wax, wherein said wax is a microcrystalline wax and said oil is a mineral oil, wherein said sheet further comprises an antibacterial, wherein the peaks are free of oil and the valleys are free of wax.

2. The textured sheet according to claim 1 wherein said plurality of valleys do not have wax disposed thereon.

3. The textured sheet according to claim 1 wherein oil is uniformly disposed on said second surface.

4. A nonwoven sheet, said sheet comprising:

a first outwardly facing surface and a second outwardly facing surface opposed thereto, wax disposed in a discontinuous wax pattern on said first surface; and oil disposed in a discontinuous oil pattern on said second surface; said oil pattern not being coincident said wax pattern, wherein said oil has a viscosity of 10 to 100 centipoise at 20° C., wherein said first surface has an average height differential of 1 to 3 mm and said second surface is flat, wherein said oil is disposed at 1 to 15%, by weight of sheet and said wax is disposed at 1 to 10%, by weight of sheet, wherein the oil and wax are a 1:1, by weight, mixture, wherein said sheet is textured, with a pattern of peaks and valleys disposed on said first surface, said wax being disposed on said peaks, said oil being disposed in said valleys of said first surface and not on said peaks of said first surface with said wax, wherein said wax is a microcrystalline wax and said oil is a mineral oil, wherein said sheet further comprises an antibacterial, wherein the peaks are free of oil and the valleys are free of wax.

5. The nonwoven sheet according to claim 4 having a basis weight of 5 to 25 weight % oil disposed thereon.

6. A duster, said duster comprising:

at least one layer of tow fibers;

a first nonwoven sheet joined thereto, said first nonwoven sheet having a first outwardly facing surface and a second surface opposed thereto, said second surface being oriented towards said tow fibers;

wax disposed in a discontinuous wax pattern on said first surface; and oil disposed in a discontinuous oil pattern on said second surface; said oil pattern not being coincident with said wax pattern, wherein said oil has a viscosity of 10 to 100 centipoise at 20° C., wherein said first surface has an average height differential of 1 to 3 mm and said second surface is flat, wherein said oil is disposed at 1 to 15%, by weight of sheet and said wax is disposed at 1 to 10%, by weight of sheet, wherein the oil and wax are a 1:1, by weight, mixture, wherein said sheet is textured, with a pattern of peaks and valleys disposed on said first surface, said wax being disposed on said peaks, said oil being disposed in said valleys of said first surface, wherein said wax is a microcrystalline wax and said oil is a mineral oil, wherein said sheet further comprises an antibacterial, wherein the peaks are free of oil and the valleys are free of wax.

7. The duster according to claim 6 wherein said oil is uniformly coated on said second surface in a continuous pattern.

8. The duster according to claim 6 wherein said layer of tow fibers has a first side oriented towards said first nonwoven sheet and a second surface opposed thereto, said duster further comprising a second nonwoven sheet and third nonwoven sheet disposed in facing relationship and bonded together to define two sleeves therebetween, said sleeves being adapted to receive a handle therein, said second nonwoven sheet being disposed on said second surface of said layer of tow fibers.

9. The duster according to claim 8 wherein said first nonwoven sheet comprises strips.

10. The duster according to claim 8 wherein said second nonwoven sheet comprises strips.

* * * * *